US011746627B1

(12) United States Patent
Jaaskelainen

(10) Patent No.: US 11,746,627 B1
(45) Date of Patent: Sep. 5, 2023

(54) DOWNHOLE FLOW SENSING WITH POWER HARVESTING AND FLOW CONTROL

(71) Applicant: Halliburton Energy Services, Inc., Houston, TX (US)

(72) Inventor: Mikko K. Jaaskelainen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/749,599

(22) Filed: May 20, 2022

(51) Int. Cl.
*E21B 43/12* (2006.01)
*E21B 47/107* (2012.01)
*E21B 47/113* (2012.01)

(52) U.S. Cl.
CPC ..... *E21B 43/12* (2013.01); *E21B 47/107* (2020.05); *E21B 47/114* (2020.05); *E21B 2200/02* (2020.05); *E21B 2200/06* (2020.05)

(58) Field of Classification Search
CPC ..... E21B 43/12; E21B 34/08; E21B 49/0875
See application file for complete search history.

(56) References Cited

U.S. PATENT DOCUMENTS 3,898,882 A * 8/1975 Prokopius ..... G01F 1/86 73/195
4,630,689 A * 12/1986 Galle ..... E21B 7/24 137/804
7,404,416 B2 * 7/2008 Schultz ..... F15C 1/22 239/589.1
2007/0261486 A1 * 11/2007 Fallet ..... E21B 47/10 73/152.29
2013/0042699 A1 2/2013 Schultz et al.
2017/0159405 A1 * 6/2017 Hazel ..... E21B 33/1277
2019/0120048 A1 * 4/2019 Coffin ..... E21B 47/06

FOREIGN PATENT DOCUMENTS

CN 111076780 A 4/2020
WO 9642000 A 12/1996
WO 2019068166 A1 4/2019
(Continued)

OTHER PUBLICATIONS

Foreign Communication from Related Application—International Search Report and Written Opinion of the International Searching Authority, International Application No. PCT/US2022/031578, dated Feb. 14, 2023, 11 pages.
(Continued)

*Primary Examiner* — Kipp C Wallace
(74) *Attorney, Agent, or Firm* — Conley Rose, P.C.; Rodney B. Carroll

(57) ABSTRACT

A method for controlling a flow of one or more fluids from a formation into a production tubing, includes measuring fluid properties of the one or more fluids passing through one or more fluidic oscillators of a flowmeter device disposed on the production tubing, adjusting the flow in a flow area based on the fluid properties through an inflow control device coupled to the production tubing and is in fluid communication with the flow meter device, and controlling, in response to change in the fluid properties, actuation of the inflow control device to adjust the flow by a controller coupled to the inflow control device.

20 Claims, 8 Drawing Sheets

(56) References Cited

FOREIGN PATENT DOCUMENTS

WO 2021025667 A1 2/2021

OTHER PUBLICATIONS

Foreign Communication from Related Application—International Search Report and Written Opinion of the International Searching Authority, International Application No. PCT/US2022/031573, dated Feb. 15, 2023, 11 pages.
Specification and Drawings for U.S. Appl. No. 63/263,898 , entitled "Oil and Gas Well Multi-Phase Fluid Flow Monitoring With Multiple Transducers and Machine Learning," 17 pages.
Electronic Acknowledgment Receipt, Specification and Drawings for International Application No. PCT/US2022/31573, entitled ""Downhole Flow Sensing With Power Harvesting and Flowcontrol,"" filed filed May 31, 2022, 39 pages.
Electronic Acknowledgment Receipt, Specification and Drawings for International Application No. PCT/US2022/31578, entitled "Downhole Flow Sensing With Power Harvesting," filed May 31, 2022, 49 pages.
Filing Receipt, Specification and Drawings for U.S. Appl. No. 17/749,605, entitled "Downhole Flow Sensing With Power Harvesting," filed May 20, 2022, 53 pages.

* cited by examiner

DOWNHOLE FLOW SENSING WITH POWER HARVESTING AND FLOW CONTROL

TECHNICAL FIELD

The present application relates generally to downhole operations and, more particularly to self-powered downhole sensing and automatic flow control in a well during the downhole operations.

BACKGROUND

Hydrocarbon production wells may start to produce water and/or gases through coning as the oil bearing layer is produced. It may be desirable to choke back flow from that zone when coning happens and to minimize water production by the zone while maximizing oil production without depleting the reservoir pressure. This may be achieved using down-hole sensing and intelligent well completions systems. In these systems, hard wired sensors may measure and communicate data to the surface, wherein algorithms identify water breakthrough and communicate to a control system in order to change the downhole inflow control device to reduce the water production from a specific zone. However, these intelligent completions may be complex and expensive, and they may tend to be deployed on high rate production wells where the cost may be justified. Thus, it may be desirable for lower cost flow sensing and automatic flow control to enable flow control in a larger populations of hydrocarbon producing wells.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
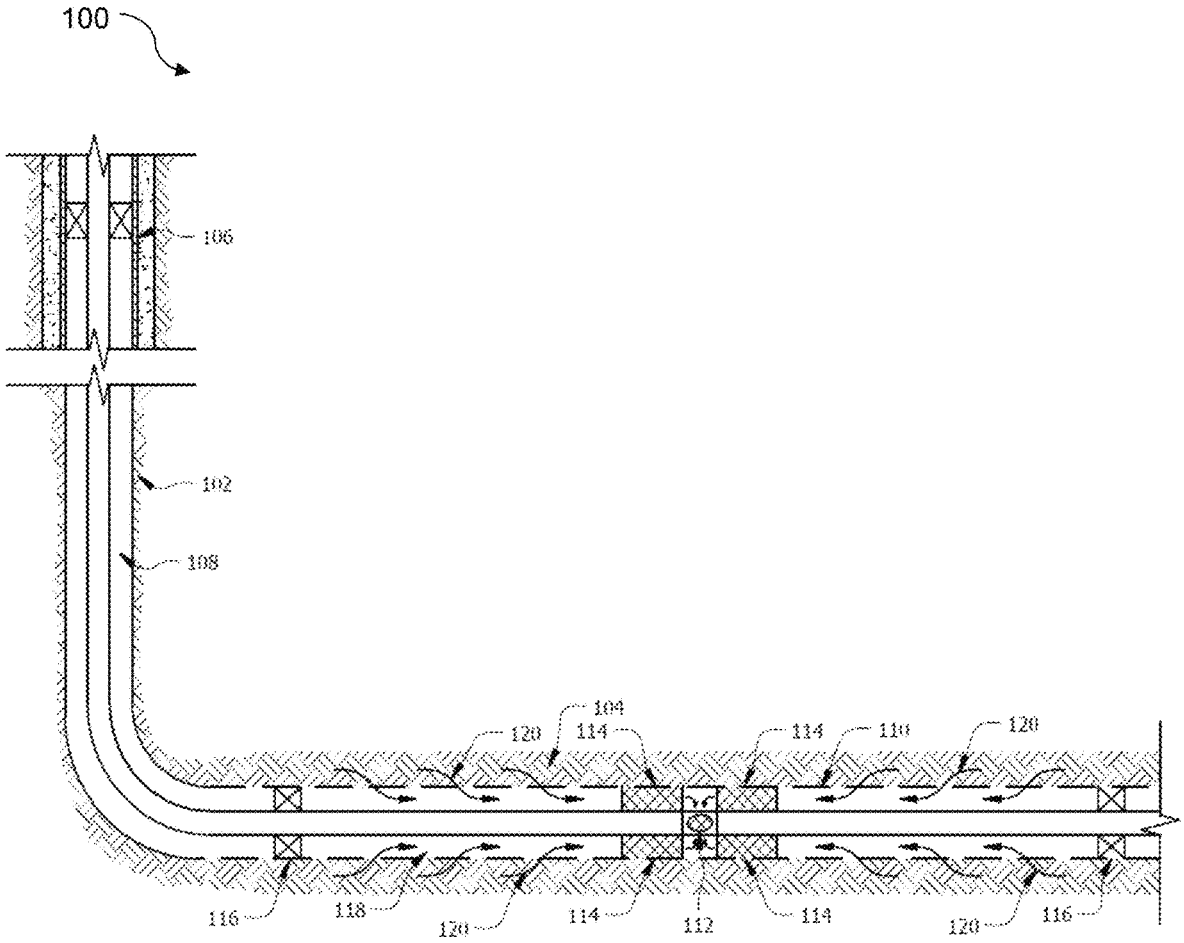
FIG. 1 illustrates an example of a well system using a plurality of flow meter devices and an inflow control device, in accordance with embodiments of the present disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure generally relates to systems and methods for sensing and automatic controlling a flow of one or more fluids from a formation into a production tubing deployed in a well. The system may comprise one or more flowmeter devices disposed on the production tubing. Each flow meter device may comprise one or more fluidic oscillators and be configured to measure fluid properties of the one or more fluids. The system may further comprise an inflow control device coupled to the production tubing and is in fluid communication with the flow meter device, and be configured to adjust the flow based on the measured fluid properties. The system may further comprise a controller coupled to the inflow control device and be configured to control actuation of the inflow control device. In some examples, the controller may be a downhole processor that acts to control the actuation of the inflow control device to restrict flow based on, for example, measured fluid properties such as frequency, differential pressure, temperature, resistance, capacitance, fluid viscosity, fluid density, oil-water ratio, amount of fluid, a phase, gas-oil ratio associated with the one or more fluids.

Thus, the disclosed flow meter device and/or fluidic oscillators may be placed in a downhole completion in such a way that the acoustic or mechanical disturbances produced by them are a determinable function of the flow rates, fluid compositions, and phase fractions, and the inflow control device may control the flow based on the determined flow rates, fluid compositions, and phase fractions.

In some embodiments, the system may further comprise one or more sensors coupled to the controller and positioned in proximity to the flowmeter device at various locations. The one or more sensors may be configured to sense, collect, analyze, and/or report data of the acoustic signals generated by the one or more fluidic oscillators. The acoustic signals emitted by each of the fluidic oscillators are detected by the one or more sensors, and the detected signals are converted into a flow rate of each of a plurality of different fluid phases in the well.

In some embodiments, the flow through the fluidic oscillators may also be used for power harvesting using piezoelectric elements disposed on the fluidic oscillators. When force/pressure fluctuations/vibrations are experienced in the fluidic oscillators, such as, due to fluid flowing through the fluidic oscillator, the piezoelectric element may convert mechanical strain into an electrical signal(s) or voltage, due to deformation of the piezoelectric element by the fluid flow. The generated electrical signal may be used for power harvesting, flow rate determination, and as an indication of gas presence. In some embodiments, the generated electric signals may be stored to a downhole energy storage device (e.g., a capacitor or a battery) attached to the piezoelectric element. The battery may then be used to power electronics to calculate setpoints of the inflow control device and to control electrically operated inflow control devices.

The disclosed systems and methods may allow for automatic downhole phase fraction sensing and fluid inflow control in order to mitigate e.g. water production while maintaining reservoir pressure. Thus, it may provide an integrated approach utilizing self powered downhole sensing and automatic flow control to optimize hydrocarbon production.

In some embodiments, the electronics controlling the inflow control device may optionally include an acoustic transducer to acoustically transmit a setting signal of the inflow control device to a fiber optic cable. In some embodiments, the system may optionally communicate through acoustic repeaters along the production tubing such that the setting is communicated to the surface. The acoustic repeaters may also enable bi-directional communication where commands may be sent from the surface to the downhole devices.

In some embodiments, one or more sensors may be included in the flow meter device, and the information may be communicated acoustically through e.g. a transducer in close vicinity of the fiber optic cable. The fiber optic cable may be clamped outside the production tubing in close proximity to the flow meter device, and information of sensor may be communicated to a Distributed Acoustic Sensing (DAS) system at a frequency substantially different from any signals generated by the fluidic oscillators.

In some embodiments, the flow meter device with one or more fluidic oscillators may alternatively be interrogated using the DAS system, where a DAS sensing fiber may be cemented behind casing or otherwise placed in a suitable location for sensing the acoustic and vibration signals as generated by the fluidic oscillators.

The above illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 illustrates an example of a well system using a plurality of flowmeter devices and an inflow control device, in accordance with embodiments of the present disclosure. As illustrated, a well system 100 may include a wellbore 102 that comprises a generally vertical uncased section that may transition into a generally horizontal uncased section extending through a subterranean formation 104. In some examples, the vertical section may extend downwardly from a portion of the wellbore 102 having a string of casing 106 cemented therein. A tubular string, such as production tubing 108, may be installed in or otherwise extended into wellbore 102.

As depicted, a well screen 110, one or more flow meter device 114, and packers 116 may be interconnected along a production tubing 108, such as along portions of the production tubing 108 in horizontal section of the wellbore 102. Each flow meter device 114 may comprise one or more fluidic oscillators disposed at a circumference of the flowmeter device 114. An inflow control device 112 may be coupled to the production tubing and is in fluid communication with the flow meter device 114. The packers 116 may be configured to seal off an annulus 118 into different intervals, also identified as zones, defined between production tubing 108 and the walls of the wellbore 102. As a result, fluids 120 may be produced from multiple intervals of the surrounding subterranean formation 108 via isolated portions of annulus 118 between adjacent pairs of packers 116. In some examples, the fluids 120 may comprise oil, water, or gas. As illustrated, in some embodiments, the well screen 110 and the flow meter 114 may be interconnected in production tubing 108 and positioned between a pair of packers 116. Without limitation, the well screens 110 may be swell screens, wire wrap screens, mesh screens, slotted screen, sintered screens, expandable screens, pre-packed screens, treating screens, or other known screen types.

In operation, the well screen 110 may be configured to filter fluids 120, which may be flowing into production tubing 108 from annulus 118. In some embodiments, the fluidic oscillators may be configured to measure fluid properties and flow rates of the fluids 120 at predefined intervals. The inflow control device 112 may be configured to restrict or otherwise regulate the flow of fluids 120 into a flow area of the production tubing 108, based on the measured fluid properties and flow rates of the fluids 120.

In some examples, the inflow control device 112 may comprise a choking sliding sleeve valve, a remotely operated valve, a remotely controlled electro-hydraulic downhole actuation device, an electronic remote equalizing device, or any other flow control device(s) used for subsurface flow control. During operations, the inflow control device may be shiftable from an open position to a closed position to differentially choke the flow area based on the measured fluid properties and the flow rates. The inflow control device 112 may be configured to close the flow area to restrict the flow when the gas-oil ratio, oil-water ratio, or an amount of water/gas in the production tubing increases above a predetermined amount, and to open the flow area to allow the fluid when the gas-oil ratio, oil-water ratio, or the amount of water/gas in the production tubing is below the predetermined amount. In this way, during operations, the inflow control device 112 may utilize fluid dynamics to prevent or reduce the flow of unwanted fluids such as water and/or gas into an interior of production tubing 108.

It should be noted that well system 100 may be one example of a wide variety of well systems in which the principles of this disclosure may be utilized. Accordingly, it should be understood that the principles of this disclosure may not be limited to any of the details of the depicted well system 100, or the various components thereof, depicted in the drawings or otherwise described herein. For example, it is not necessary in keeping with the principles of this disclosure for the wellbore 102 to include a generally vertical wellbore section or a generally horizontal wellbore section. Moreover, it is not necessary for the fluids 120 to be only produced from subterranean formation 104 since, in other examples, fluids may be injected into subterranean formation 104, or fluids 120 may be both injected into and produced from subterranean formation 104, without departing from the scope of the disclosure. Furthermore, any number, arrangement and/or combination of such components may be used, without departing from the scope of the disclosure.

Advantages of being able to regulate the flow of fluids 120 into production tubing 108 from each zone of subterranean formation 104 may, for example, prevent water coning or gas coning in subterranean formation 104. Other uses for flow regulation in a well may include, but are not limited to, balancing production from (or injection into) multiple zones, minimizing production or injection of undesired fluids, maximizing production or injection of desired fluids, etc.

Figure 2A:
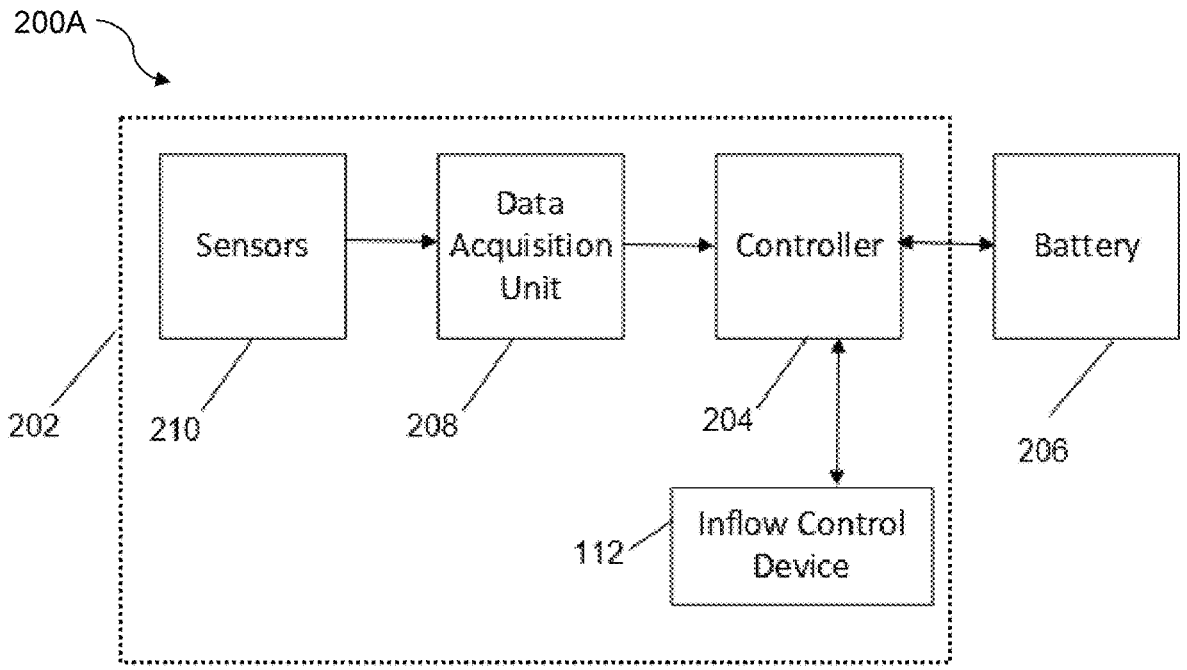
FIG. 2A illustrates a block diagram depicting a configuration of electronic circuitry attached the inflow control device, in accordance with embodiments of the present disclosure

FIG. 2A illustrates a block diagram depicting a configuration of electronic circuitry attached the inflow control device, in accordance with embodiments of the present disclosure. As discussed above, the inflow control device 112 may be configured to restrict or otherwise regulate the flow of fluids 120 into a flow area of the production tubing 108, based on the measured fluid properties of the fluids 120. During operations, the inflow control device may be shiftable from an open position to a closed position to differentially choke the flow area based on the measured fluid properties using sensor(s) 210. The fluid properties may comprise frequency, differential pressure, temperature, resistance, capacitance, fluid viscosity, fluid density, oil-water ratio, amount of fluid, a phase, gas-oil ratio associated with the one or more fluids.

As illustrated in FIG. 2A, the inflow control device 112 may further be coupled to an electronic circuitry 202 to adjust the fluid flow. The electronic circuitry 202 may comprise a controller 204 coupled to the inflow control device 112 to control the actuation of the inflow control device 112 based on the measured fluid properties. The controller 204 may be coupled to one or more actuators to operate the inflow control device 112. The controller 204 may be used for storing and executing instructions. In general, the controller 204 includes a processor for executing instructions and a memory for storing instructions to be executed by the processor and may further include one or more input/output (I/O) modules for communication between the controller 204 and other electronic components.

The controller 204 may have any suitable number, type, or configuration of processors. The processor may include any hardware, software or both that operates to control and process information. The processor may include, without limitation, a programmable logic device, a microcontroller, a microprocessor, a digital signal processor, any suitable processing device, or any suitable combination of the preceding. The processor may execute one or more instructions or sets of instructions to actuate the inflow control device 112, including the steps described below with respect to FIG. 2B. The processor may also execute any other suitable programs to facilitate adjustable flow control. The controller may further include, without limitation, switching units, a logic unit, a logic element, a multiplexer, a demultiplexer, a switching element, an I/O element, a peripheral controller, a bus, a bus controller, a register, a combinatorial logic element, a storage unit, a programmable logic device, a memory unit, a neural network, a sensing circuit, a control circuit, a digital to analog converter (DAC), an analog to digital converter (ADC), an oscillator, a memory, a filter, an amplifier, a mixer, a modulator, a demodulator, a power storage device, and/or any other suitable devices.

In some embodiments, the electronic circuitry 202 may be connected to a power source. In one embodiment, the power source may be a battery 206 electrically connected to the controller 204 to store the power.

In some embodiments, the controller 204 may be further coupled to a data acquisition unit 208 which may be further coupled to one or more sensors 210. The one or more sensors 210 may be positioned in proximity to the flowmeter device to sense the acoustic signals generated by the one or more fluidic oscillators for measuring the fluid properties and converting the properties into electrical signals. The data acquisition unit 208 may be configured to receive a data output (e.g., electric signals) from the one or more sensors 210, and to transmit the data output to the controller 204. After receiving the electrical signals, the controller 204 may execute instructions based, at least in part, on the electrical signal. One or more of the instructions executed by the controller 204 may include causing the processor to send one or more signals to one or more of the actuators, causing the actuators to actuate the inflow control device 112 and to adjust the flow.

In some embodiments, the controller 204 may be configured to actuate the inflow control device 112 in response to at least one of one or more flow rate signals. For example, in response to the one or more flow rate signals received by the sensor 210, controller 204 may transmit an actuation or command signal to the inflow control device 112 corresponding to one or more flow rate signals received by the sensors 210. In one or more embodiments, a first flow rate signal may correspond to or be indicative of a first configuration of the inflow control device 112. For example, when the sensor 210 detects the first flow rate signal, the controller 204 may actuate one or more actuators to move at inflow control device 112 from a closed configuration or position to an open configuration or position, or a partially open position. As another example, a subsequent flow rate signal may correspond to or be indicative of a closed configuration of inflow control device 112. When the sensor 210 detects the second flow rate profile, the controller 204 may actuate one or more actuators to move inflow control device 112 from an open configuration to a closed or a partially closed configuration.

Figure 2B:
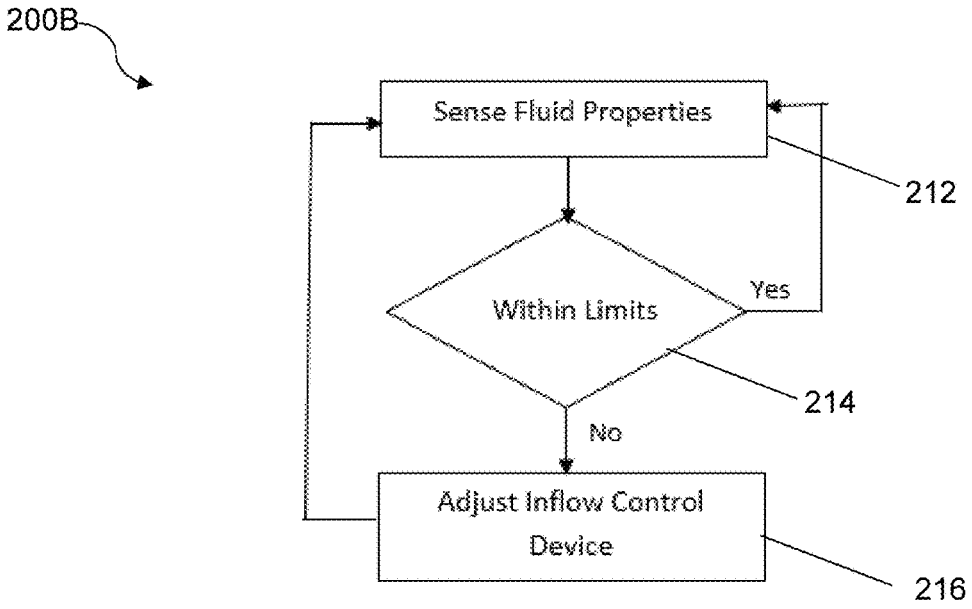
FIG. 2B illustrates a flow chart of a process for adjusting the inflow control device, in accordance with embodiments of the present disclosure.

FIG. 2B illustrates a flow chart 200B of a process for adjusting the inflow control device 112, in accordance with embodiments of the present disclosure. As discussed above, the inflow control device 112 may be configured to restrict or otherwise regulate the flow of fluids 120 into a flow area of the production tubing 108 based on the measured fluid properties and flow rates of the fluids 120.

At step 212, the flow meter device 114 may sense the fluid properties using the one or more sensors 202. The fluid properties may comprise frequency, differential pressure, temperature, resistance, capacitance, fluid viscosity, fluid density, oil-water ratio, amount of fluid, a phase, gas-oil ratio associated with the one or more fluids.

At step 214, signals emitted by each of the fluidic oscillators may be detected by the one or more sensors 202, and the detected signals may be analyzed to determine whether the amount or ratio of different fluids are within predetermined limits. In response to determination, the process proceeds to step 216 when the amount or ratio of different fluids are not within predetermined limits, or the process proceeds back to step 212 when the amount or ratio of different fluids are within predetermined limits In some embodiments, the detected signals may be analyzed with a machine learning approach to obtain flow rates and proportions of typical fluid phases (water, oil, gas) in the flow stream. In some embodiments, the detected signals may be entered into an artificial neural network trained by entering a training data set comprising measured signals from each of the plurality of the fluidic oscillators in response to a plurality of fluid compositions, phase fractions and flow rates. In some embodiments, the training data set may consist of the measured response for a variety of surface tensions, densities and viscosities. Such variety of compressibility, surface tension, densities and viscosities may provide training data for various fluid compositions and flow rates at various reservoir conditions, such as different temperatures and pressures.

At step 216, the controller may actuate the inflow control device from an open configuration to a close or a partially close configuration to restrict the flow when the gas-oil ratio, oil-water ratio, or an amount of water/gas in the production tubing increases above a predetermined amount, and from the closed configuration to the open configuration when the gas/oil ratio, oil/water ratio, or the amount of water or gas in the production tubing is below the predetermined amount. In this way, during operations, the inflow control device 112 may utilize fluid dynamics to prevent the flow of unwanted fluids such as water and/or gas into an interior of production tubing 108.

Figure 3A:
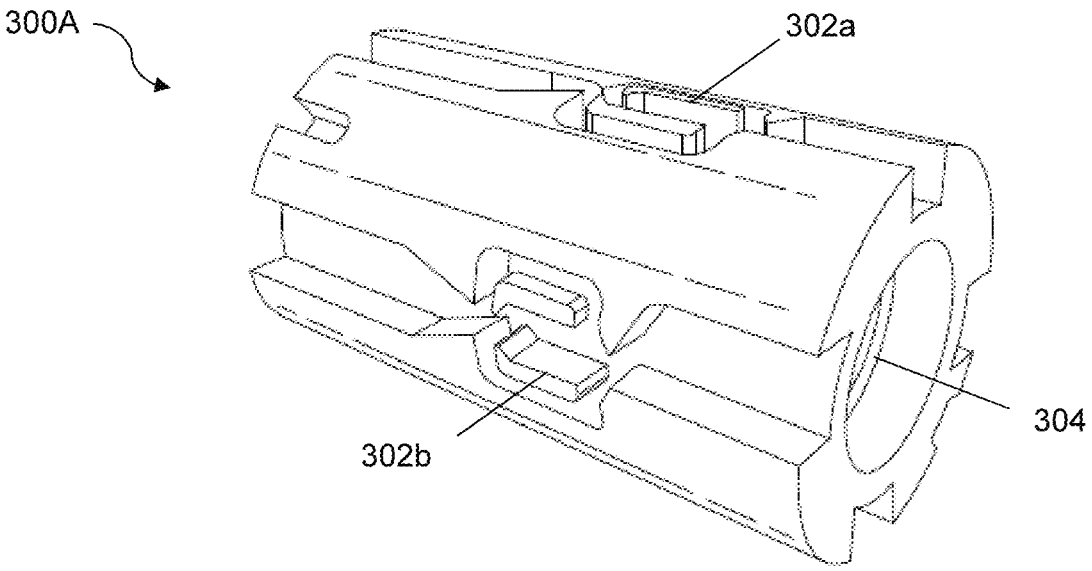
FIGS. 3A-3B illustrates perspective views of a flow meter device, in accordance with embodiments of the present disclosure.
Figure 3B:
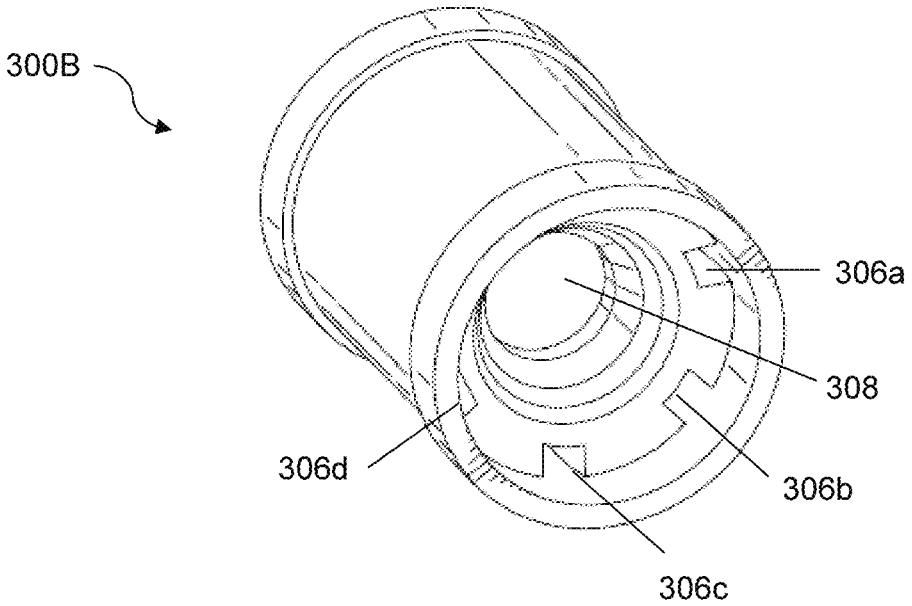

FIGS. 3A-3B illustrate perspective views of a flow meter device, in accordance with embodiments of the present disclosure. FIG. 3A illustrate a perspective view 300A of a flowmeter device 302 (e.g., the flowmeter device 114) positioned in the wellbore 102. In some examples, the flow meter device 302 may be positioned in the casing or other suitable flow line of the wellbore 102. The flow meter device 302 may be used to determine flow rate and other information relating to fluid flowing with respect to the wellbore 102. The flow meter device 302 may include a set of acoustic devices 304*a-d* such as the fluidic oscillator, and a bore hole 306. In some embodiments, the fluidic oscillator 304*a-d* may comprise a symmetric fluidic oscillator or asymmetric fluidic oscillator. While illustrated with four acoustic devices 304*a-d*, the flow meter device 302 may include other suitable amounts (e.g., less than four or more than four) of acoustic devices 304. The flow meter device 302 may include any other suitable components.

FIG. 3B illustrates another perspective view of a flow meter device 300B positioned in the wellbore 102. The flow meter device 308 may include a set of acoustic devices 310*a-d* such as the fluidic oscillator, and a bore hole 312. While illustrated with four acoustic devices 310*a-d*, the flow meter device 308 may include other suitable amounts (e.g., less than four or more than four) of acoustic devices 310*a-d*. The flow meter device 308 may include any other suitable components to direct fluid flow. As illustrated, the acoustic devices 310*a-d* are positioned near the circumference of the flow meter device 308, but the acoustic devices 310*a-d* may be positioned in other suitable locations with respect to the flow meter device 302.

In some embodiments, the flow meter device 302/308 may include an amount of acoustic devices 306/310 that corresponds to an amount of phases of fluid from the wellbore 102. For example, if the fluid includes four phases (gas/oil/water/sand), then the flow meter device 302 may include (e.g., as illustrated) four acoustic devices 304. The acoustic devices 304*a-d* may be positioned to detect or otherwise sense data relating to one or more phases of the fluid. For example, the acoustic device 304*a* may be positioned to sense data about a gas phase of the fluid, the acoustic device 304*b* may be positioned to sense data about a combination oil-gas phase of the fluid, the acoustic device 304*c* may be positioned to sense data about a water phase of the fluid, etc. The bore hole 306 may be positioned in (or approximately in) the center of the flow meter device 302. The size of the bore hole 306, the shape of the bore hole 306, or a combination thereof may be selected based on expected fluid properties, the acoustic device 304 type or placement, desired measurements, other suitable parameters, or any combination thereof. In some examples, the bore hole 306 may be omitted.

In some embodiments, the fluidic oscillators 306/310 may generate acoustic signals that propagate to sensing fiber (or other suitable detection devices, such as pressure transducers, etc.) behind or within a casing of a wellbore. In some examples, the signals generated by the fluidic oscillator may be detected by one or more DAS systems. Additionally or alternatively to DAS systems, other techniques may be used. The techniques may involve various implementations of Rayleigh scattering, Raman scattering, or Brillouin scattering, and the techniques may be interferometric in nature. The sensing techniques may involve using sensing principles such as homodyne, heterodyne, Michelson, Mach-Zender, Fabry-Perot, phase based, intensity based, coherence based, static (e.g., absolute), or dynamic (e.g., relative). Single-point sensing and multi-point sensing based on Fiber Bragg Gratings or various intrinsic sensing principles or extrinsic sensing principles may also be used in various configurations.

In some embodiments, the flow meter device 302/308 with the fluidic oscillators 306/310 respectively may meter the multi-phase flow through the acoustic signals, such as through a frequency or flow rate relationship. Additionally, analysis of the acoustic signals in the fluid column may be performed and may be used to determine information (e.g., fluid type, flow rate, etc.) relating to the fluid. In some examples, the analysis can involve using Doppler effects, acoustic velocity, dispersion, attenuation or amplitude effects, and the like. Recording and analyzing the acoustic signals with respect to the fluid may involve recording the signal at one or more points upstream from the flow meter device 302, downstream from the flow meter device, or a combination thereof. Recording and analyzing the acoustic signals may additionally involve array-based acoustic sampling to determine Doppler effects, acoustic velocity, dispersion, amplitude (attenuation) effects, and the like.

Each fluidic oscillator that is included in the flow meter device may oscillate at one frequency for a given fluid, which can be a respective fundamental frequency. The fluidic oscillator may generate acoustic signals corresponding to the fundamental frequency of the fluidic oscillator and associated harmonics. More than one fluidic oscillator may be included in a flow meter device, and each fluidic oscillator in the flow meter device may correspond to different fundamental frequencies and associated harmonics.

In some embodiments, the fluidic oscillators 306/310 may be positioned inline with the flow control device fluid flow path. This may be symmetrically around the device as shown in FIGS. 3A-3B or in a flow path designed into the completion such that the fluid passing through the flow control device is the same fluid passing through the fluidic oscillators.

Figure 4:
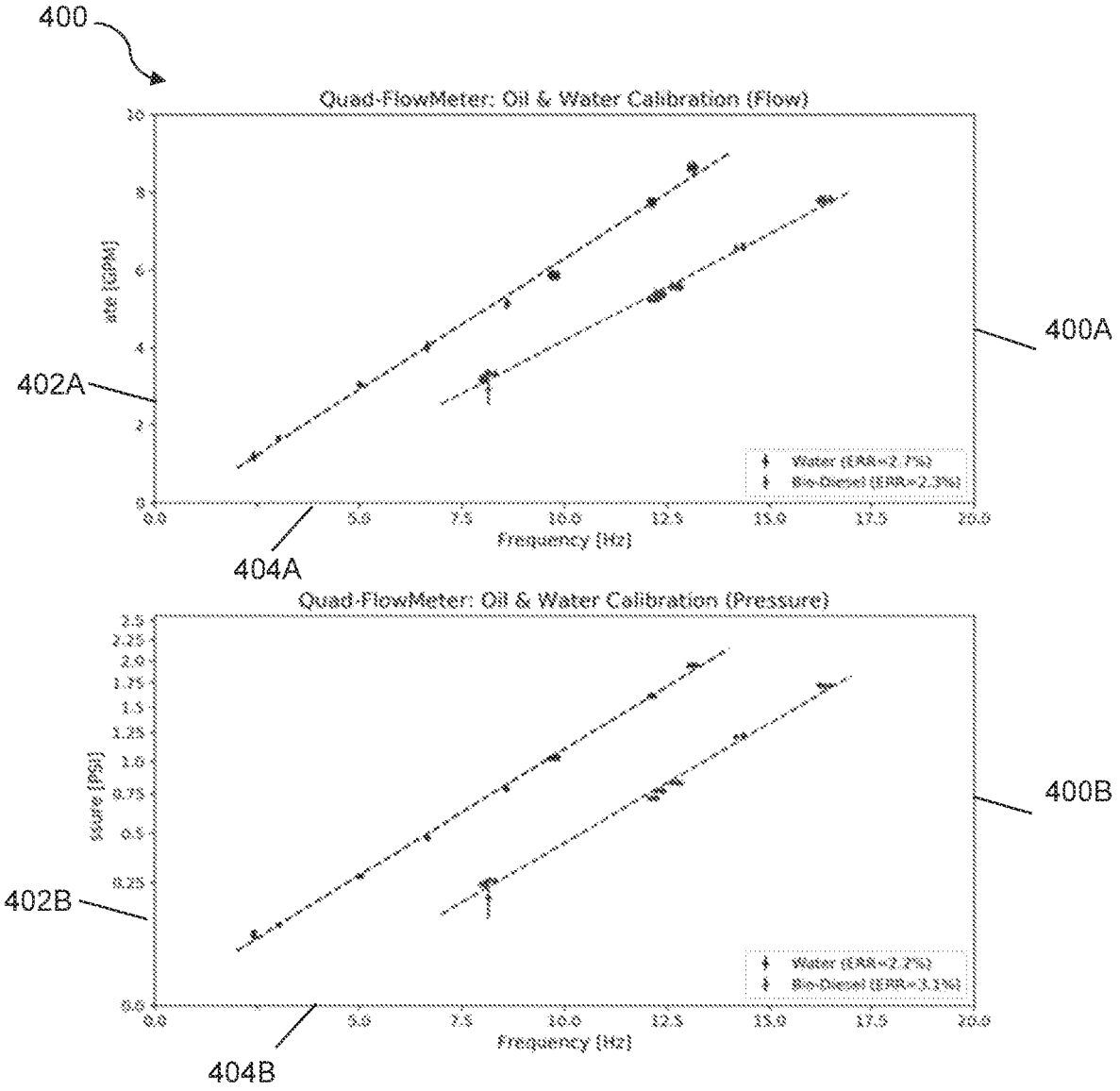
FIG. 4 illustrates graphs between flow rate versus frequency/pressure, in accordance with embodiments of the present disclosure.

FIG. 4 illustrates graphs 400 between flow rate/pressure versus frequency of oscillation of the fluidic oscillators, in accordance with embodiments of the present disclosure. As discussed above, the flow meter device 302 or 308 may include one or more acoustic devices such as the fluidic oscillator to facilitate single-phase measurements or multi-phase measurements. The frequency of oscillation of the fluid may depend on various factors. For example, the frequency of oscillation of the fluid may be a linear function of the flow rate of the fluid. Additionally or alternatively, the frequency of oscillation of the fluid may depend on pressure drop (e.g., the square root of the pressure drop) in the fluidic oscillator. The frequency of oscillation may depend on other suitable factors relating to the fluidic oscillator. In some examples, the oscillation of the fluid in the fluidic oscillator may cause acoustic signals to be generated. In some examples, the generated signals may be proportional to flow rate and fluid properties of fluid that pass through the fluidic oscillator. Thus, analysis of the acoustic/electric signals in the fluid column may be performed and may be used to determine information (e.g., a fluid type, a flow rate, a fluid composition, a fluid density, and the like) relating to the fluid.

The graph 400A may depict the information taken from acoustic/electric signals generated by the fluidic oscillators of the flowmeter device 114. The graph 400A may plot flow rate (x-axis 402A) as a function of frequency of oscillations (y-axis 404A) at predefined intervals. The graph 400B may plot pressure (x-axis 402B) as a function of frequency of oscillations (y-axis 404B) at predefined intervals. The flowmeter device may be a two-phase quad fluidic flowmeter. The fluidic oscillators may be characterized and calibrated for various flow rates and fluid phases at suitable downhole conditions. The calibration measurements may be done with selected downhole sensors that will be deployed, and calibration curves may be generated and used to determine fluid and phase flow rates.

Figure 5:
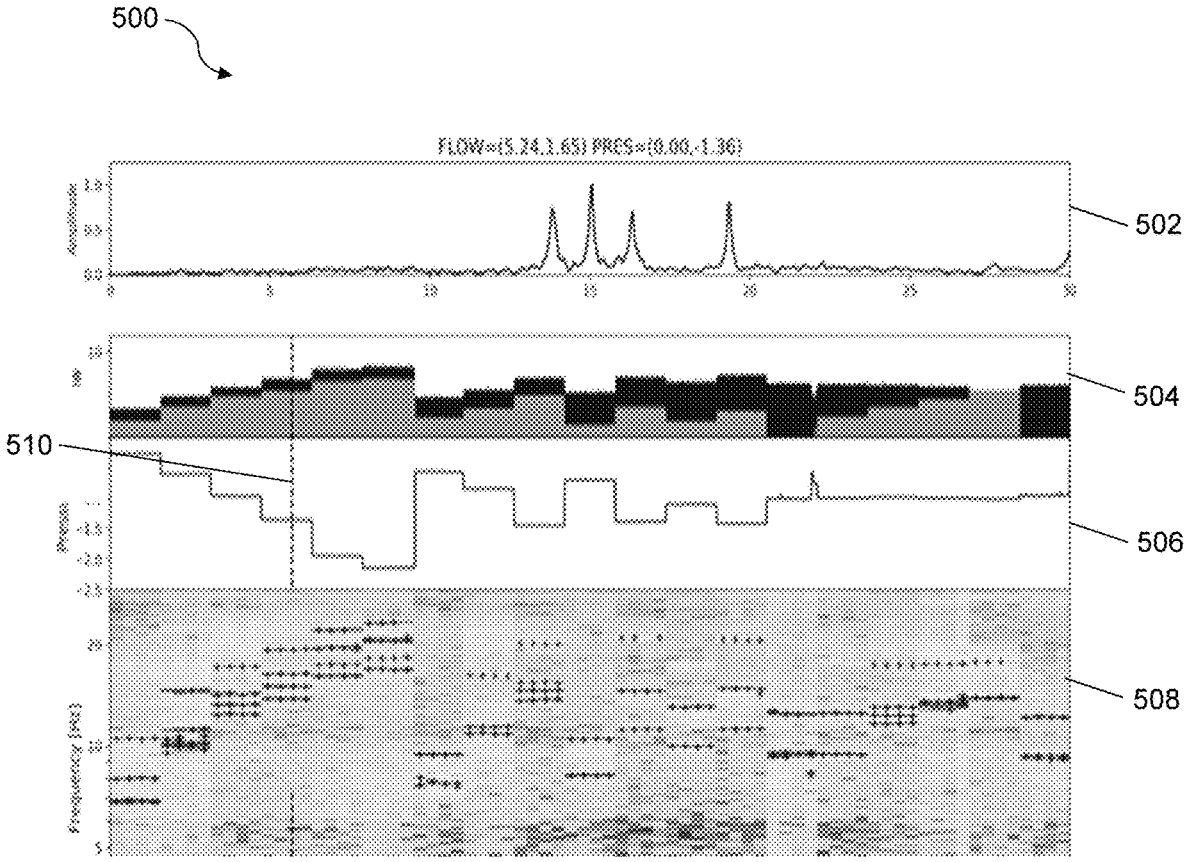
FIG. 5 illustrates graphs of multi-phase measurements of a flow meter device, in accordance with embodiments of the present disclosure.

FIG. 5 illustrates graph 500 of multi-phase measurements of a flow meter device, in accordance with embodiments of the present disclosure. In some embodiments, the graph 500 may represent measured frequencies as a function of fluid flow rate and fluid composition. As discussed above, the flow meter device 302 or 308 may include one or more acoustic devices such as the fluidic oscillator to facilitate single-phase measurements or multi-phase measurements. The fluidic oscillators may be substantially similar or have unique mechanical dimensions and frequency responses to fluid flow. A subsurface flow meter device may be deployed in a largely horizontal section that allow for fluid phase identification. The fluid from the wellbore 102 may include a single-phase fluid or a multi-phase fluid. For example, the fluid from the wellbore 102 may include oil, water, gas, other suitable material, or any suitable combination thereof. For example, the flow meter device (e.g., 302 or 304) may include one, two, three, four, or more fluidic oscillators. A subsurface flow meter module deployed in a largely horizontal section would allow for fluid phase identification. The multiple substantially similar fluidic oscillators may generate similar frequency outputs for a given single phase fluid like e.g. oil. As shown in graph 500, a laminar fluid flow scenario with a mix of 50% oil and 50% water may generate two frequencies, one for oil going through the fluidic oscillators on the upper half and one for water going through the lower half of the subsurface flow meter module. A combination of e.g. 2 different fluidic oscillator types in the subsurface flow meter module may generate 4 frequencies in this scenario.

As shown in FIG. 5, multiple measurements across different fluid flow combinations may be displayed. The first top display 502 may show a graph of amplitude vs. frequency, the second display 504 may show the fluid flow combinations with fluid 1 in black and fluid 2 in grey, the third display 506 may show a pressure drop for the different fluid flow combinations, and the fourth bottom display 508 may show a water fall plot of acoustic data with frequency vs. time where darker colors show higher intensities. As shown in water fall plot, the higher acoustic intensities in this case may be automatically identified using a machine learning algorithm and marked with "+" signs. The dotted line 510 crossing multiple displays may show how the data ties together for a given fluid combination. The frequency (y-axis) and signs in the fourth bottom display 510 align with the frequency peaks in the first top display 502, and the differential pressure measurement complements the acoustic data to provide a unique measurement for a given flow combination.

Figure 6:
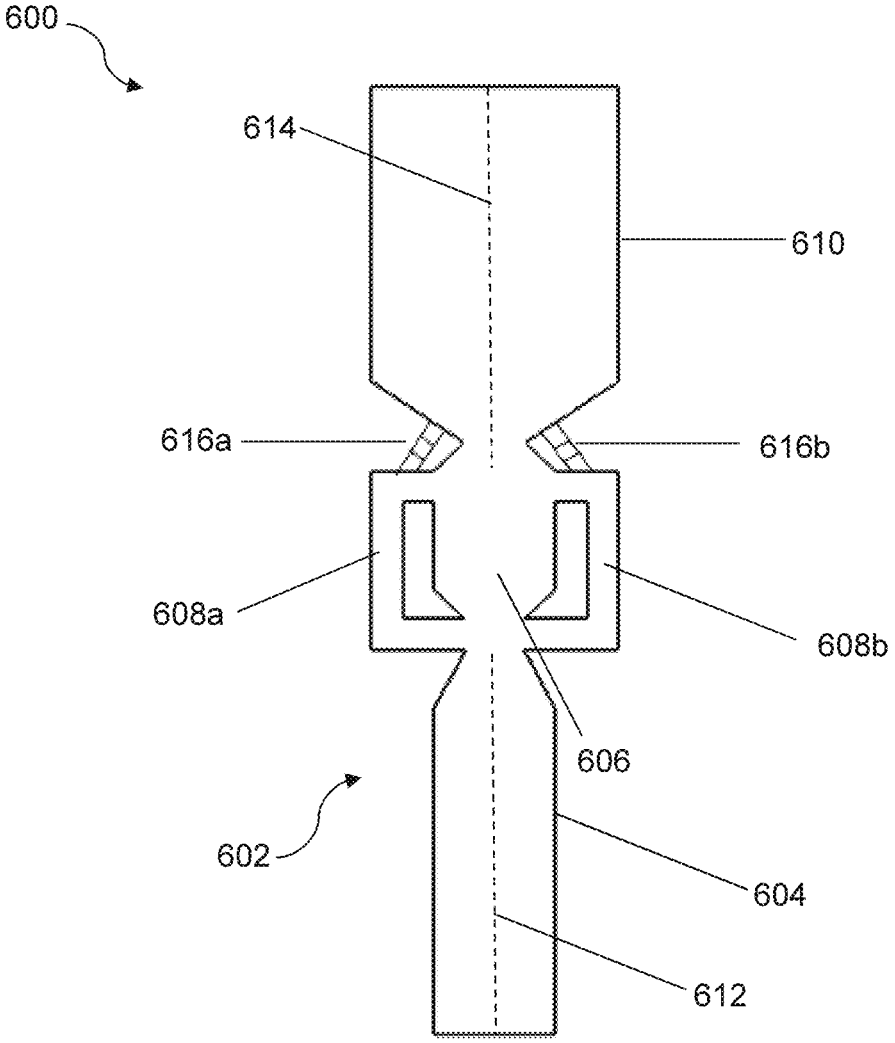
FIG. 6 illustrates a downhole power harvesting apparatus using a symmetric fluidic oscillator and piezoelectric elements, in accordance with embodiments of the present disclosure.

FIG. 6 illustrates a downhole power harvesting apparatus using a symmetric fluidic oscillator and piezoelectric elements, in accordance with embodiments of the present disclosure. In some embodiments, the flow through the fluidic oscillators may also be used for power harvesting using piezoelectric elements disposed on the fluidic oscillators. When force/pressure fluctuations/vibrations are experienced in the fluidic oscillators, such as, due to fluid flowing through the fluidic oscillator, the piezoelectric element may convert mechanical strain into an electrical signal(s) or voltage, due to deformation of the piezoelectric element by the fluid flow. The generated electrical signal may be used for power harvesting, flow rate determination, and as an indication of gas presence. In some embodiments, the generated electric signals may be stored to a downhole energy storage device (e.g., a capacitor or a battery) attached to the piezoelectric element. The battery may then be used to power electronics to calculate setpoints of the inflow control device and to control electrically operated inflow control devices.

In some embodiments, the fluidic oscillator may comprise symmetric fluidic oscillator or asymmetric fluidic oscillator. As shown in FIG. 6, the downhole power harvesting apparatus may comprise a symmetric fluidic oscillator 602 having an inlet channel 604, a mixing chamber 606, feedback loops 608*a-b*, and an outlet channel 610. The inlet channel 604 may be coupled to the mixing chamber 606, which may be coupled to the feedback loops 608*a-b* and the outlet channel 610. The symmetric fluidic oscillator 602 may include other or different suitable components. As illustrated in FIG. 6, the inlet channel 604 is symmetric about axis 612, but the inlet channel 604 may be symmetric about other suitable axes or may be asymmetric. The outlet channel 612 may be symmetric. For example, the outlet channel 612 may be symmetric along any suitable axes of the outlet channel 612. As illustrated, the outlet channel 612 is symmetric about axis 114, which may be similar or identical to the axis 612 of the inlet channel 604.

The downhole power harvesting apparatus 600 may further comprise one or more piezoelectric elements 616*a*, 616*b* disposed on at least one side of the outlet channel 610. In some embodiments, the one or more piezoelectric elements 616*a*, 616*b* may be disposed on both sides of the outlet channel 610 to generate twice the power output. For example, piezoelectric electrical output may be placed in a push-pull type arrangement when the piezoelectric elements 616*a*, 616*b* used on both arms of the symmetric fluidic oscillator 602, to generate twice the power output. In some examples, the one or more piezoelectric elements 616*a*, 616*b* may comprise a piezoelectric film, a piezoelectric ceramic, a piezoelectric crystalline material, and a piezoelectric fiber-composite material.

The piezoelectric elements 616*a*, 616*b* may comprise high flexible elements. The piezoelectric elements 616*a*, 616*b* may be configured to deform and generate electrical currents when placed under pressures. For example, the piezoelectric elements 616*a*, 616*b* may use piezoelectric effect to measure changes in pressure, acceleration, temperature, strain, or force in flow through the symmetric fluidic oscillator 602 and convert them to an electrical signal(s). In some embodiments, the piezoelectric elements 616*a*, 616*b* may be further coupled to a charging circuit and a downhole energy storage device to store the electric signal. The downhole energy storage may include a battery or a capacitor configured to power a memory tool, an acoustic sensor, a pressure sensor, or a transducer. The battery may then be used to power electronics to calculate setpoints of the inflow control device and to control electrically operated inflow control devices.

In some cases, the acoustic signals generated from the symmetric fluidic oscillator 602 may not include an intensity large enough to be detected with respect to the wellbore. Accordingly, the fluidic oscillator may be asymmetric to generate acoustic signals with increased intensity compared to the other fluidic oscillators.

Figure 7:
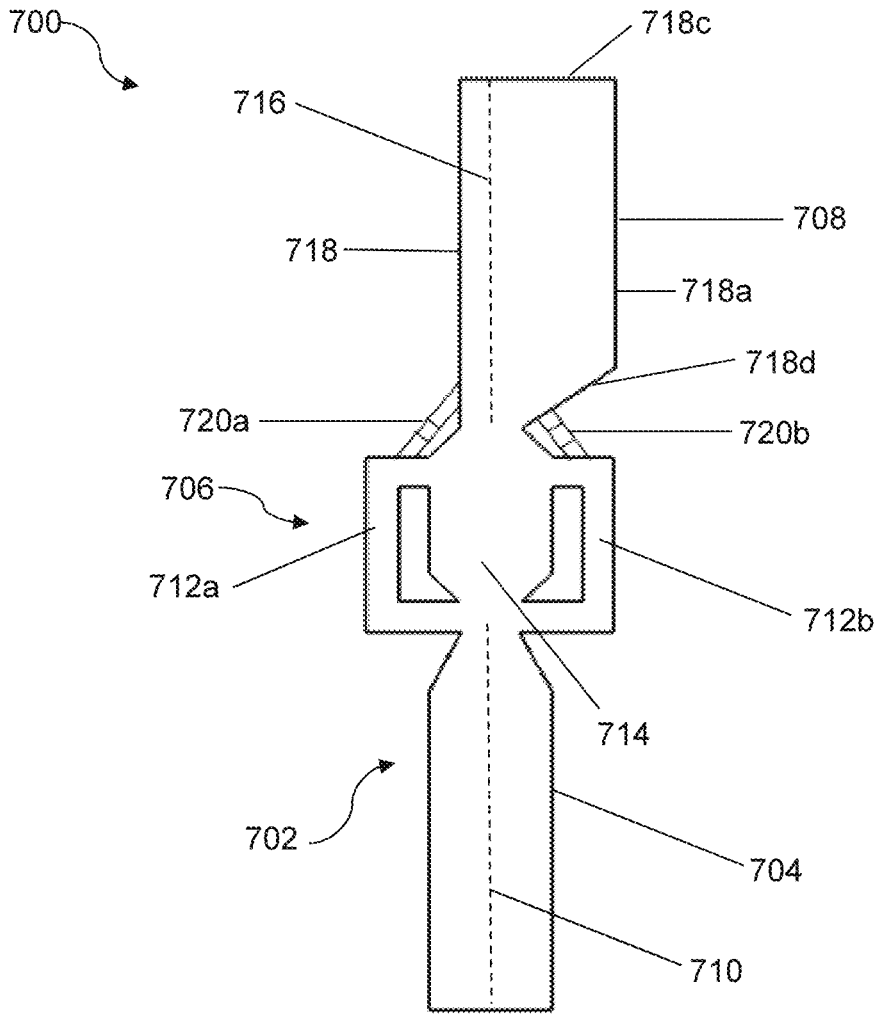
FIG. 7 illustrates downhole power harvesting apparatus using an asymmetric fluidic oscillator and piezoelectric elements, in accordance with embodiments of the present disclosure.

FIG. 7 illustrates a downhole power harvesting apparatus 700 using an asymmetric fluidic oscillator, in accordance with embodiments of the present disclosure. The asymmetric fluidic oscillator 702 may include an inlet channel 704, a feedback system 706, an outlet channel 708, and any other suitable components. The inlet channel 704 may include a receiving path in the asymmetric fluidic oscillator 702. For example, the inlet channel 704 may receive fluid (e.g., from the casing or other suitable components of a wellbore) that may originate upstream from the asymmetric fluidic oscillator 702, and the inlet channel 704 may direct the fluid further into the asymmetric fluidic oscillator 702 such as into the feedback system 706. The inlet channel 704 may be symmetric or asymmetric. As illustrated in FIG. 7, the inlet channel 704 is symmetric about axis 710, but the inlet channel 704 may be symmetric about other suitable axes or may be asymmetric.

As illustrated, the feedback system 706 may be coupled (e.g., mechanically) to the inlet channel 704 and the outlet channel 708. Additionally or alternatively, the feedback system 706 may be coupled to other suitable components of the asymmetric fluidic oscillator 702. As illustrated, the feedback system 706 may include a first feedback loop 712*a*, a second feedback loop 712*b*, and a mixing chamber 714. The feedback system 706 may include any other suitable components and may be otherwise suitable shaped or configured. For example, the feedback system 706 may include more or fewer feedback loops (712*a*, 712*b*), a differently sized or shaped mixing chamber 714, differently shaped or sized feedback loops 712, etc. for oscillating the fluid.

The outlet channel 708 may be coupled (e.g., mechanically) to the feedback system 706. For example, the outlet channel 708 may be coupled to the feedback loops 712*a-b*, the mixing chamber 714, to other suitable components, or to any suitable combination thereof. The outlet channel 708 may define an exit path for fluid received from the feedback system 706. For example, fluid may be received from the feedback system 706 by the outlet channel 708, and the outlet channel 708 may direct the fluid out (e.g., into the casing of the wellbore or other suitable component thereof) of the asymmetric fluidic oscillator 702.

As shown in FIG. 7, the outlet channel 708 may be asymmetric. For example, the outlet channel 708 may not be symmetric along any suitable axes of the outlet channel 708. As illustrated, the outlet channel 708 is not symmetric about axis 716, which may be similar or identical to the axis 710 of the inlet channel 704. The asymmetric nature of the outlet channel 708 may cause disruptions or other suitable variations in the flow of fluid that passes through the outlet channel 708. For example, the asymmetry of the outlet channel 708 may interrupt the natural flow of the fluid, and the interruption may cause vibrations or other suitable acoustic signals that may be larger or that otherwise may include higher intensities than signals produced from symmetric fluidic oscillators.

As illustrated in FIG. 7, the outlet channel 708 is an irregularly shaped quadrilateral. But, the outlet channel 708 may be or otherwise include any other suitable irregular or asymmetric shapes (e.g., an irregular pentagon, a regular quadrilateral having jagged edges, etc.). The outlet channel 708 may include a right side 718*a*, a left side 718*b*, a top side 718*c*, and a bottom side 718*d*. The right side 718*a* may be connected to the bottom side 718*d* and to the top side 718*c*, the left side 718*b* may be connected to the top side 718*c* and to the feedback system 706, and the bottom side 718*d* may be connected to the feedback system 706. The right side 718*a* and the left side 718*b* may be substantially parallel to one another. In other examples, the right side 718*a* and the left side 718*b* may be non-parallel. Additionally, the top side 718*c* and the bottom side 718*d* may be non-parallel for forming the asymmetric feature of the outlet channel 708. In some examples, the asymmetric feature may be formed via the bottom side 718*d* coupling to the feedback system 706 in a first location, while the left side 718*b* is coupled in a second location to the feedback system 706. Accordingly, the right side 718*a* may be shorter than the left side 718*b*, and the bottom side 718*d* may include a defined and non-zero slope.

Fluid received by the inlet channel 704 may be directed to the feedback system 706. For example, the inlet channel 704 may receive produced fluid from the wellbore and may direct the produced fluid to the feedback system 706. The produced fluid may enter the feedback system 706 (e.g., via the feedback loops 712*a-b*, the mixing chamber 714, or a combination thereof) and may oscillate or otherwise suitably flow. For example, the produced fluid may travel through the first feedback loop 712*a* or the second feedback loop 712*b* and into the mixing chamber 714 (e.g., via one or more iterations). The produced fluid may be directed into the outlet channel 708.

The downhole power harvesting apparatus 200 may further comprise one or more piezoelectric elements 720*a*, 720*b* disposed on at least one side of the outlet channel 708. In some embodiments, the one or more piezoelectric elements 720*a*, 720*b* may be disposed on both sides of the outlet channel 708. The piezoelectric elements 720*a*, 720*b* may generate electrical currents when placed under pressures. The piezoelectric elements 720*a*, 720*b* may be engaged with asymmetric fluidic oscillator 702 in such a way that the piezoelectric element generates electric power in response to variations in fluid pressure/frequency of fluctuations in flow through the asymmetric fluidic oscillator 702. Piezoelectric electrical output may be placed in a push-pull type arrangement when used on both arms of the asymmetric fluidic oscillator 702, to generate twice the power output.

The asymmetric nature of outlet channel 708 may cause disruption of flow of the produced fluid through the outlet channel 708. The disruption may propagate from the outlet channel 708 to the feedback system 706 or to other suitable components of the asymmetric fluidic oscillator 702 or of the wellbore. The disruption in the flow of the produced fluid may cause vibrations and the piezoelectric elements 720*a*, 720*b* may generate electrical currents when placed under pressures. The electric signals generated via the disruption may include a periodicity that is different than non-disrupted flow and may include an intensity that is higher than an intensity of signals generated via symmetric fluidic oscillators or other types of acoustic devices.

In some embodiments, the piezoelectric elements 720*a*, 720*b* in the asymmetric fluidic oscillator may pick-up frequency of oscillations induced in the asymmetric fluidic oscillator 702 for the flow measurements. The frequency of oscillation of the fluid may depend on various factors. For example, the frequency of oscillation of the fluid may be a linear function of the flow rate of the fluid. Additionally or alternatively, the frequency of oscillation of the fluid may depend on pressure drop (e.g., the square root of the pressure drop) in the asymmetric fluidic oscillator 702. The frequency of oscillation may depend on other suitable factors relating to the asymmetric fluidic oscillator 702.

In some embodiments, the asymmetric fluidic oscillator 702 may be included in a flow meter device and may cause acoustic signals to be generated via oscillating fluid flow in the asymmetric fluidic oscillator 702.

Figure 8:
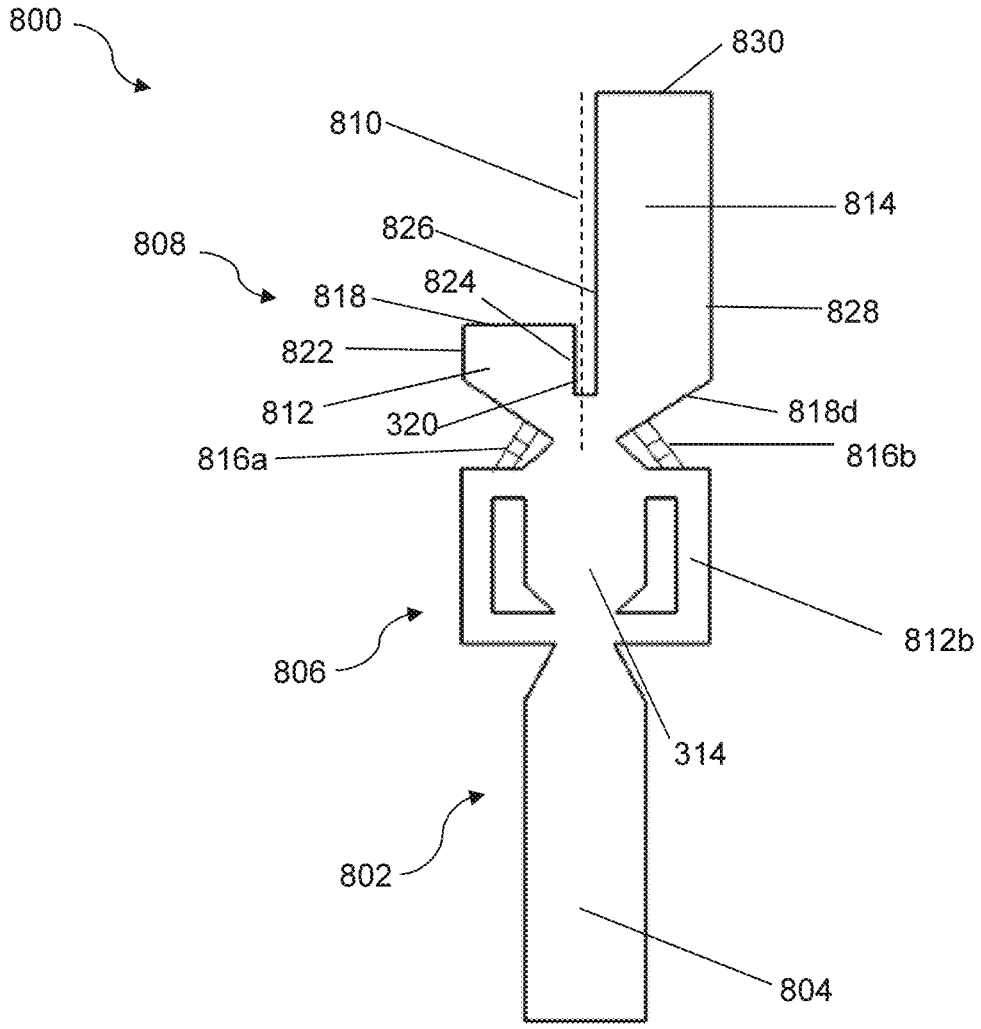
FIG. 8 illustrates another downhole power harvesting apparatus using an asymmetric fluidic oscillator and piezoelectric elements, in accordance with embodiments of the present disclosure.

FIG. 8 illustrates another downhole power harvesting apparatus 800 using an asymmetric fluidic oscillator, in accordance with embodiments of the present disclosure. The asymmetric fluidic oscillator 802 may include an inlet channel 804, a feedback system 806, and an outlet channel 808. As illustrated, the inlet channel 804 is similar to the inlet channel 804, and the feedback system 806 is similar to the feedback system 806. But, the inlet channel 804, the feedback system 806, or a combination thereof may differ from corresponding features of the asymmetric fluidic oscillator 802. The asymmetric fluidic oscillator 802 may be included in the flow meter device and may cause acoustic signals to be generated via oscillating fluid flow in the asymmetric fluidic oscillator 802.

The inlet channel 804 may be coupled (e.g., mechanically) to the feedback system 806, which may, in turn, be coupled to the outlet channel 808. The outlet channel 808 may be asymmetric. For example, the outlet channel 808 may not include any axes about which the outlet channel 808 is symmetric. In some examples, the outlet channel 808 may be asymmetric about axis 810, which may extend along a flow direction of fluid through the asymmetric fluidic oscillator 802.

The outlet channel 308 may include a first portion 812 and a second portion 814 and, optionally, other portions for disrupting flow of fluid through the asymmetric fluidic oscillator 802 to generate acoustic signals. The first portion 812 may be coupled (e.g., mechanically) to the feedback system 806 at a first location on which a first piezoelectric element 816*a* may be disposed, and the second portion 814 may be coupled to the feedback system 806 at a second location on which a second piezoelectric element 816*b* may be disposed, which may be different than the first location. The second portion 814 may allow flow of fluid through the asymmetric fluidic oscillator 802. But, the first portion 812 may not allow flow of fluid through the asymmetric fluidic oscillator 802. For example, the first portion 812 may include a cap 818 or may otherwise be blocked so that fluid may not exit through the outlet channel 308 via the first portion 812. Accordingly, fluid flow through the outlet channel 808 may be disrupted, and vibrations or acoustic signals may be generated based on the disrupted flow of the fluid.

As illustrated, the outlet channel 808 includes the first portion 812 and the second portion 814 that are separated by buffer 820. The first portion 812 and the second portion 814 may include differing measurements or features. For example, a left side 822 of the first portion 812 and a right side 824 of the first portion 812 may be shorter or otherwise smaller than a left side 826 of the second portion 814 and the right side 828 of the second portion 814, respectively. Additionally, the cap 818 of the first portion may restrict or otherwise prevent flow of fluid through the outlet channel 808 via the first portion 812, while a top 830 of the second portion 814 may be open or otherwise allow flow of the fluid through the outlet channel 808 via the second portion 814. In some examples, the first portion 812 may allow flow, while the second portion 814 restricts or obstructs the flow. The outlet channel 808 may include other suitable amounts of portions, which may include other suitable features or measurements, with sufficient asymmetry to produce the acoustic signals.

The downhole power harvesting apparatus 800 may further comprise one or more piezoelectric elements 816*a*, 816*b* disposed on at least one side of the outlet channel 308. In some embodiments, the one or more piezoelectric elements 816*a*, 816*b* may be disposed on both sides of the outlet channel 808. The piezoelectric elements 816*a*, 816*b* may generate electrical currents when placed under pressures. The piezoelectric elements 816*a*, 816*b* may be engaged with asymmetric fluidic oscillator 802 in such a way that the piezoelectric element generates electric power in response to variations in fluid pressure/frequency of fluctuations in flow through the asymmetric fluidic oscillator 802. Piezoelectric electrical output may be placed in a push-pull type arrangement when used on both arms of the asymmetric fluidic oscillator 802, to generate twice the power output.

The asymmetric nature of outlet channel 808 may cause disruption of flow of the produced fluid through the outlet channel 808. The disruption may propagate from the outlet channel 308 to the feedback system 806 or to other suitable components of the asymmetric fluidic oscillator 802 or of the wellbore. The disruption in the flow of the produced fluid may cause vibrations and the piezoelectric elements 816*a*, 816*b* may generate electrical currents when placed under pressures.

In some aspects, apparatus and methods for self-powered downhole sensing and automatic flow control in a well during the downhole operations are provided according to one or more of the following examples.

ADDITIONAL DISCLOSURE

The following are non-limiting, specific embodiments in accordance with the present disclosure:

A first embodiment, which is a system for controlling a flow of one or more fluids from a formation into a production tubing, comprising a flowmeter device disposed on the production tubing and comprising one or more fluidic oscillators disposed at a circumference of the flowmeter and configured to measure fluid properties of the one or more fluids, an inflow control device coupled to the production tubing and is in fluid communication with the flow meter device, and configured to adjust the flow in a flow area based on the fluid properties, and a controller coupled to the inflow control device and configured to control actuation of the inflow control device in response to change in the fluid properties.

A second embodiment, which is the system of the first embodiment, wherein the one or more fluids comprise oil, water, or gas, and wherein the fluid properties comprise frequency, differential pressure, temperature, resistance, capacitance, fluid viscosity, fluid density, oil-water ratio, amount of fluid, a phase, and/or gas-oil ratio associated with the one or more fluids.

A third embodiment, which is the system of any of the first and the second embodiments, further comprising one or more sensors coupled to the controller and positioned in proximity of the flowmeter device to sense signals generated by the one or more fluidic oscillators for measuring the fluid properties.

A fourth embodiment, which is the system of any of the first through the third embodiments, further comprising a data acquisition unit coupled between the one or more sensors and the controller, and configured to receive a data output from the one or more sensors, and to transmit the data output to the controller.

A fifth embodiment, which is the system of the first through the fourth embodiments, wherein the inflow control device comprises a choking sliding sleeve valve or a remotely operated valve A sixth embodiment, which is the system of any of the first through the fifth embodiments, wherein the inflow control device is a choking sliding sleeve valve which is operable to shift from an open position to a closed position to differentially choke the flow area based on any change in the measured fluid properties.

A seventh embodiment, which is the system of any of the first through the sixth embodiments, wherein the inflow control device is configured to close the flow area when the gas-oil ratio, oil-water ratio, or an amount of water or gas in the production tubing exceeding a predetermined amount, and wherein the inflow control device is configured to open the flow area when the gas-oil ratio, oil-water ratio, or the amount of water or gas in the production tubing is below the predetermined amount.

An eighth embodiment, which is the system of any of the first through the seventh embodiments, wherein the one or more fluidic oscillators comprise a symmetric fluidic oscillator that generates an acoustic signal proportional to flow rates and the fluid properties of the one or more fluids.

A ninth embodiment, which is the system of any of the first through the eighth embodiments, wherein the one or more fluidic oscillators comprise an asymmetric fluidic oscillator that generates an acoustic signal proportional to flow rates and the fluid properties of the one or more fluids, and wherein the asymmetric fluidic oscillator includes an asymmetry along an axis oriented in a direction of flow of the fluid through the asymmetric fluidic oscillator.

A tenth embodiment, which is the system of any of the first through the ninth embodiments, wherein the one or more fluidic oscillators comprise at least one piezoelectric element configured to generate an electric signal in response to variations in pressure of the fluid, and wherein the at least one piezoelectric element is coupled to a capacitor or a battery to store the electric signal and to power a memory tool, an acoustic sensor, a pressure sensor, or a transducer.

An eleventh embodiment, which is the system of any of the first through the tenth embodiments, wherein the flowmeter device is further coupled to a measurement device to detect the acoustic signals generated by the one or more fluidic oscillators.

A twelfth embodiment, which the system of any of the first through the eleventh embodiments, wherein the measurement device comprises a fiber-optic cable or acoustic transducer and communicatively coupled to a detection system via a wired connection, a wireless connection, or a combination thereof.

A thirteenth embodiment, which is a method for controlling a flow of one or more fluids from a formation into a production tubing, comprising measuring fluid properties of the one or more fluids passing through one or more fluidic oscillators of a flowmeter device disposed on the production tubing, adjusting the flow in a flow area based on the fluid properties through an inflow control device coupled to the production tubing and is in fluid communication with the flow meter device, and controlling, in response to change in the fluid properties, actuation of the inflow control device to adjust the flow by a controller coupled to the inflow control device.

A fourteenth embodiment, which is the method of the thirteenth embodiment, wherein the one or more fluids comprise oil, water or gas, and wherein the fluid properties comprise frequency, differential pressure, temperature, resistance, capacitance, fluid viscosity, fluid density, oil-water ratio, amount of fluid, a phase, gas-oil ratio associated with the one or more fluids.

A fifteenth embodiment, which is the method of any of the any of the thirteenth and the fourteenth embodiments, further comprising sensing signals generated by the one or more fluidic oscillators for measuring the fluid properties by one or more sensors coupled to the controller and positioned in proximity of the flowmeter device.

A sixteenth embodiment, which is the method of any of the thirteenth through the fifteenth embodiments, further comprising receiving a data output from the one or more sensors and transmitting the data output to the controller.

A seventeenth embodiment, which is the method of any of the thirteenth through the sixteenth embodiments, wherein the inflow control device comprises a choking sliding sleeve valve or a remotely operated valve.

An eighteenth embodiment, which is the method of any of the thirteenth through the seventeenth embodiments, further comprising shifting the inflow control device from an open position to a closed position to differentially choke the flow area based on the measured fluid properties.

A nineteenth embodiment, which is the method of any of the thirteenth through the eighteenth embodiment, wherein the one or more fluidic oscillators comprise an asymmetric fluidic oscillator that generates an acoustic signal proportional the fluid properties of the one or more fluids, and wherein the first asymmetric fluidic oscillator includes an asymmetry along an axis oriented in a direction of flow of the fluid through the asymmetric fluidic oscillator.

A twentieth embodiment, wherein the one or more fluidic oscillators comprise at least one piezoelectric element configured to generate an electric signal in response to variations in pressure of the fluid, and wherein the at least one piezoelectric element is coupled to a capacitor or a battery to store the electric signal and to power a memory tool, an acoustic sensor, a pressure sensor, or a transducer.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

I claim:

1. A system for controlling a flow of one or more fluids from a formation into a production tubing, comprising:

a flowmeter device disposed on the production tubing and comprising one or more fluidic oscillators disposed at a circumference of the flowmeter and configured to generate acoustic signals proportional to flow rate and fluid properties of the one or more fluids passing through the one or more fluidic oscillators, wherein the one or more fluidic oscillators comprise an asymmetric fluidic oscillator;

an inflow control device coupled to the production tubing and is in fluid communication with the flow meter device, and configured to adjust the flow in a flow area based on the generated acoustic signals; and a controller coupled to the inflow control device and configured to automatically control actuation of the inflow control device in response to change in the fluid properties.

2. The system of claim 1, wherein the one or more fluids comprise oil, water, or gas, and wherein the fluid properties comprise frequency, differential pressure, temperature, resistance, capacitance, fluid viscosity, fluid density, oil-water ratio, amount of fluid, a phase, and/or gas-oil ratio associated with the one or more fluids.

3. The system of claim 1, further comprising one or more sensors coupled to the controller and positioned in proximity of the flowmeter device to sense signals generated by the one or more fluidic oscillators for measuring the fluid properties.

4. The system of claim 3, further comprising a data acquisition unit coupled between the one or more sensors and the controller, and configured to receive a data output from the one or more sensors, and to transmit the data output to the controller.

5. The system of claim 1, wherein the inflow control device comprises a choking sliding sleeve valve or a remotely operated valve.

6. The system of claim 1, wherein the inflow control device is a choking sliding sleeve valve which is operable to shift from an open position to a closed position to differentially choke the flow area based on any change in the measured fluid properties.

7. The system of claim 6, wherein the inflow control device is configured to close the flow area when the gas-oil ratio, oil-water ratio, or an amount of water or gas in the production tubing exceeding a predetermined amount, and wherein the inflow control device is configured to open the flow area when the gas-oil ratio, oil-water ratio, or the amount of water or gas in the production tubing is below the predetermined amount.

8. The system of claim 1, wherein the one or more fluidic oscillators further comprise a symmetric fluidic oscillator that generates an acoustic signal proportional to the flow rates and the fluid properties of the one or more fluids.

9. The system of claim 1, wherein the asymmetric fluidic oscillator includes an asymmetry along an axis oriented in a direction of flow of the fluid through the asymmetric fluidic oscillator.

10. The system of claim 1, wherein the one or more fluidic oscillators comprise at least one piezoelectric element configured to generate an electric signal in response to variations in pressure of the fluid, and wherein the at least one piezoelectric element is coupled to a capacitor or a battery to store the electric signal and to power a memory tool, an acoustic sensor, a pressure sensor, or a transducer.

11. The system of claim 1, wherein the flowmeter device is further coupled to a measurement device to detect the acoustic signals generated by the one or more fluidic oscillators.

12. The system of claim 1, wherein the measurement device comprises a fiber-optic cable or acoustic transducer and communicatively coupled to a detection system via a wired connection, a wireless connection, or a combination thereof.

13. A method for controlling a flow of one or more fluids from a formation into a production tubing, comprising:

generating acoustic signals proportional to flow rate and fluid properties of the one or more fluids passing through one or more fluidic oscillators of a flowmeter device disposed on the production tubing, wherein the one or more fluidic oscillators comprise an asymmetric fluidic oscillator;

adjusting the flow in a flow area based on the generated acoustic signals through an inflow control device coupled to the production tubing and is in fluid communication with the flow meter device; and controlling, in response to change in the fluid properties, actuation of the inflow control device to adjust the flow by a controller coupled to the inflow control device.

14. The method of claim 13, wherein the one or more fluids comprise oil, water or gas, and wherein the fluid properties comprise frequency, differential pressure, temperature, resistance, capacitance, fluid viscosity, fluid density, oil-water ratio, amount of fluid, a phase, gas-oil ratio associated with the one or more fluids.

15. The method of claim 13, further comprising sensing signals generated by the one or more fluidic oscillators for measuring the fluid properties by one or more sensors coupled to the controller and positioned in proximity of the flowmeter device.

16. The method of claim 13, further comprising receiving a data output from the one or more sensors and transmitting the data output to the controller.

17. The method of claim 13, wherein the inflow control device comprises a choking sliding sleeve valve or a remotely operated valve.

18. The method of claim 13, further comprising shifting the inflow control device from an open position to a closed position to differentially choke the flow area based on the measured fluid properties.

19. The method of claim 13, wherein the asymmetric fluidic oscillator includes an asymmetry along an axis oriented in a direction of flow of the fluid through the asymmetric fluidic oscillator.

20. The method of claim 19, wherein the one or more fluidic oscillators comprise at least one piezoelectric element configured to generate an electric signal in response to variations in pressure of the fluid, and wherein the at least one piezoelectric element is coupled to a capacitor or a battery to store the electric signal and to power a memory tool, an acoustic sensor, a pressure sensor, or a transducer.

* * * * *